US006828501B2

(12) United States Patent
Eves et al.

(10) Patent No.: US 6,828,501 B2
(45) Date of Patent: Dec. 7, 2004

(54) CABLE

(75) Inventors: David A. Eves, Crawley (GB); Philippa C. Wagner, London (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/155,210

(22) Filed: May 24, 2002

(65) Prior Publication Data

US 2002/0189833 A1 Dec. 19, 2002

(30) Foreign Application Priority Data

Jun. 19, 2001 (GB) ..... 0114978

(51) Int. Cl.[7] ..... H01B 7/18
(52) U.S. Cl. ..... 174/36; 174/109
(58) Field of Search ..... 174/36, 108, 109, 174/117 M; 138/130

(56) References Cited

U.S. PATENT DOCUMENTS 3,126,442 A 3/1964 Roberts ..... 174/69
3,177,901 A * 4/1965 Pierce ..... 138/130
4,317,000 A * 2/1982 Ferer ..... 138/130
4,491,939 A 1/1985 Carpenter ..... 367/20
4,504,696 A * 3/1985 Piper ..... 174/32
4,677,256 A 6/1987 Bauer et al. ..... 174/116
5,485,774 A 1/1996 Osborne ..... 87/6
5,539,851 A * 7/1996 Taylor et al. ..... 385/101
6,121,547 A 9/2000 Harada ..... 174/36

FOREIGN PATENT DOCUMENTS

DE 200 03 100 U 1 * 6/2000

* cited by examiner

*Primary Examiner*—Chau N. Nguyen
(74) *Attorney, Agent, or Firm*—Aaron Waxler

(57) ABSTRACT

A multi-conductor cable is provided based on a braided structure. Be selectively braiding together conductive yarns with non conductive yarns, a multi-conductor electrical cable can be provided by just one braid. In this example, two electrical conductors are provided, a first provided by conductive yarn and a second provided by conductive yarn. Insulating yarns maintain conductive yarns in spaced relation to each other.

13 Claims, 2 Drawing Sheets

CABLE

FIELD OF THE INVENTION

The present Invention relates to electrical cables and more particularly to electrical cables having a braided construction.

BACKGROUND OF THE INVENTION

It is known for electrical cables to include one or more braid of electrically insulating material for providing insulation for the electrical conductors of th cable. Furthermore braids of electrically conductive material may be formed around one or more insulated conductors to provide a shielding. Cables flaying multiple conductors may be produced, each being individually insulated, but such cables become more bulky as the number of conductors increases. The increase in bulk may be minimised by reducing the diameter of the conductors or the thickness of the insulation, but such measures can reduce the performance of the cable.

Cables having multiple conductors can also be provided by arranging the conductors side-by-side to form so called ribbon cables, but such cables can occupy a large area making them unsuitable for use in some applications. It can also be difficult to provide electromagnetic shielding for conductors of such cables.

SUMMARY OF THE INVENTION

In accordance with the present invention there is provided a cable formed as an elongate body of electrically insulating material, said body having two or more electrical conductors disposed relative to a surface of the elongate body and arranged to extend along the length of the elongate body, wherein each of the at least two electrical conductors are arranged to remain separate from one another along the length of the elongate body.

Optionally, at least one of the two or more electrical conductors are at least partially enclosed by the electrically insulating material forming the elongate body. In this case, the elongate body may be of a first braided construction having at least one conductive element providing electrical continuity between one end of the elongate body and an other end of the elongate body and so provide one of the said electrical conductors. Furthermore, the first braided construction may have two or more conductive elements, each providing electrical continuity between one end of the elongate body and an other end of the elongate body and so each provide one of the said electrical conductors, each conductive element in the first braided construction being held in spaced relationship and therefore in electrical isolation from other conductive elements of the first braided construction by electrically insulating material of the braided construction.

The electrical conductors may be of a conductive metal, metal coated insulators or carbon fibre or conductive polymers.

The electrical insulators may be of nylon, polyamide, acetate, cotton or wool.

These and other aspects of the present invention appear in the appended claims which are incorporated herein by reference and to which the reader is now referred.

BRIEF DESCRIPTION OF THE DRAWING

The present invention will now be described with reference to the Figures of the accompanying drawings in which.

Figure 1A:
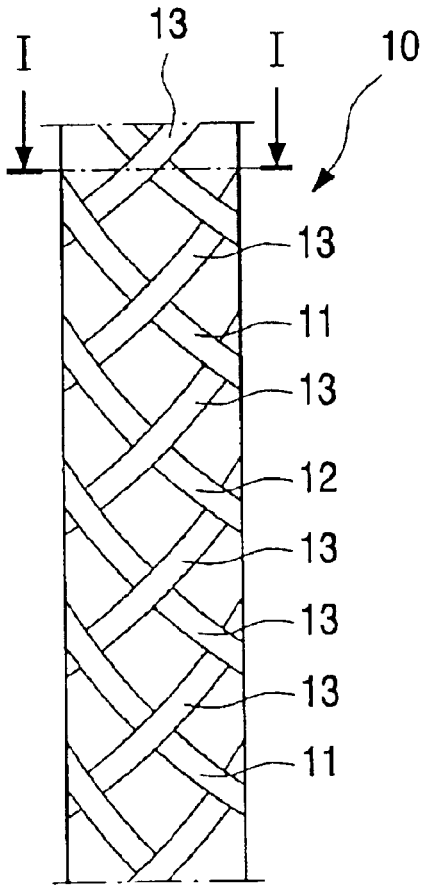
FIG. 1*a* shows a first view of a portion of first embodiment cable made in accordance with the present invention.
Figure 1B:
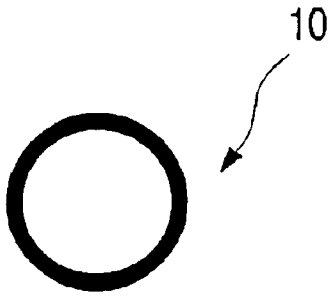
FIG. 1*b* shows a cross sectional view taken across line I—I of FIG. 1*a;*

It should be noted that the drawings are diagrammatic and not drawn to scale. Relative dimensions and proportions of parts of the Figures have been shown exaggerated or reduced in size for the sake of clarity and convenience in the drawings. The same reference signs are generally used to refer to corresponding or similar features in the different embodiments.

DETAILED DESCRIPTION OF THE PRIMARY EMBODIMENT

Referring to FIG. 1*a*, cable 10 is of a braided construction having a first conductive yarn 11. second conductive yarn 12 and insulating yarns 13. The first conductive yarn 11 and second conductive yarn 12 extend in the longitudinal direction of the cable 10 from one end to the other, each forming a helix. The first conductive yarn 11 and second conductive yarn 12 are held apart from one another and therefore in electrical isolation due to the interwoven insulating yarn 13 of the braiding. Hence, the helical path traced out by yarns of braiding is exploited to provide a multi-conductor electrical cable In the form of just one braid. By varying the braiding pattern used and the number of conductive yarns used, the number of separate electrical conductors provided can be increased beyond two. The insulating yarns 13 may progress in a helix in the same or opposite direction to that in which the conductive yarns progress.

Figure 2A:
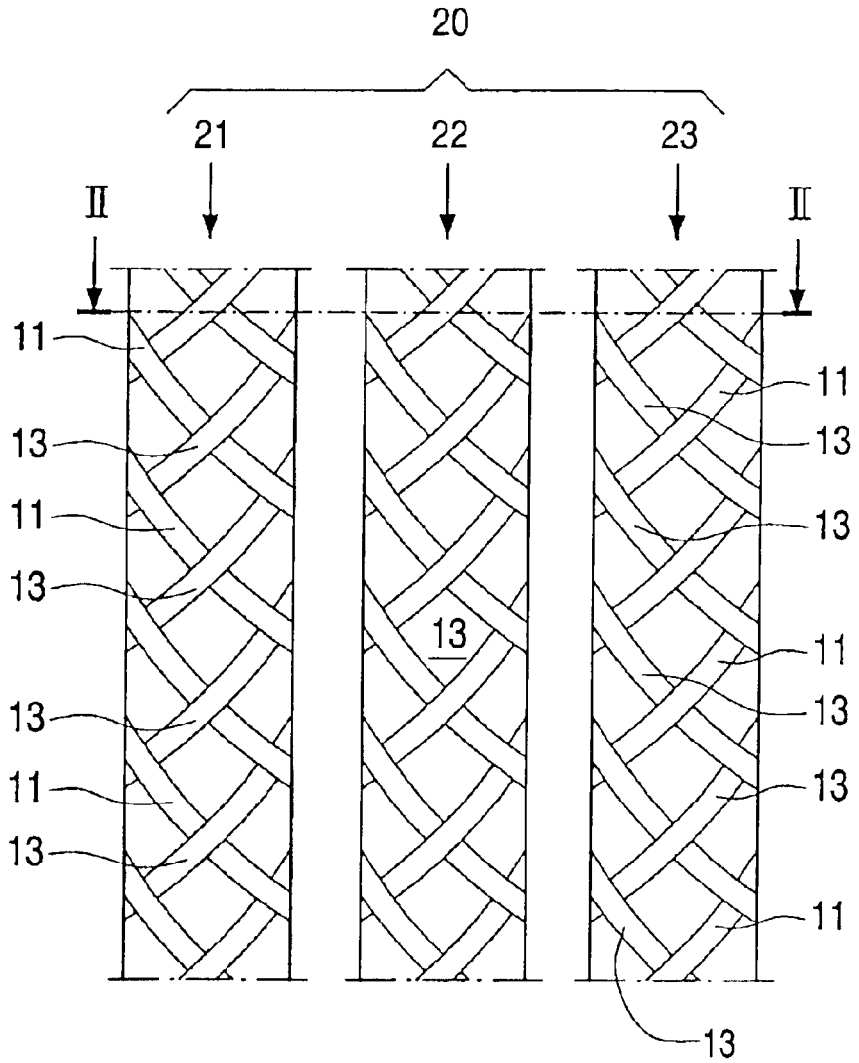
FIG. 2*a* shows views of portions of a second embodiment cable made in accordance with the present invention.
Figure 2B:
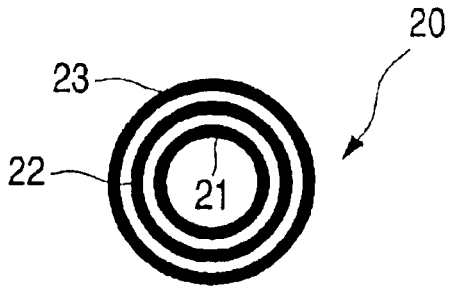
FIG. 2*b* shows a cross sectional view of the second embodiment cable taken across portions as indicated by line II—II of FIG. 2*a*.

Referring to FIG. 2, a second embodiment of the present invention is shown as cable 20 having three concentric braiding structures 21, 22 and 23, with braiding 21 innermost and braiding 23 outermost. Braiding 21 includes conductive yarn 11 forming a helix spiralling in a first direction as it travels along an axial direction of the cable. Braiding 22 is located between inner braiding 21 and outer braiding 23 and is formed of insulating yarns 13. Outer braiding 23 includes conductive yarn 11 forming a helix spiralling in a second direction opposite to helix direction formed by conductive yarn 11 of braiding 21. Hence yarn 11 of braiding 21 and yarn 11 of braiding 23 co-operate to form a twisted pair arrangement suitable for carrying electrical signals. Cable structures having more than three concentric braids may be provided.

Further braiding layers, each of which may include insulation and/or electrical conductors may be provided, as will be apparent to the person skilled in the art. Such braided constructions may also be used in conjunction with more traditional cable types. Optical fibre elements may be included in the cable.

The conductive yarns can be formed from conductive materials such as metal, carbon fibre conductive polymers or conductive polymers having a conductive property due to their composition. The conductive yarns may be formed by coating insulators such as polyamide coated with conductive materials such as nickel, copper, aluminium, gold and silver. Coating techniques include electroless plating. The insulating yarn 13 is made of insulating material such as nylon, polyamide, acetate, cotton and wool. Yarns may be monofilament or multifilament and each yarn may comprise more than one material. Each braid may comprise more than one yarn type. Conductive yarns may comprise a mixture of conductive and insulative materials.

While comparatively few yarns making up the braids are shown in the Figures of the drawing it will be apparent to the person skilled in the art that many more will normally be present.

From reading the present disclosure, other modifications will be apparent to persons skilled in the art. Such modifications may involve other features which are already known in the design, manufacture and use of cables, garments, upholstered articles and other soft furnishings and applications thereof and which may be used instead of or in addition to features already described herein.

What is claimed is:

1. A cable formed as an elongate body of electrically insulating material, said body having two or more electrical conductors disposed relative to a surface of the elongate body and arranged to helically extend along the length of the elongate body, wherein each of the two or more electrical conductors are arranged to remain in electrical isolation from one another along the length of the elongate body by means of a helically interwoven electrically insulating material.

2. A cable in accordance with claim 1 wherein at least one of the two or more electrical conductors is at least partially enclosed by the electrically insulating material forming the elongate body.

3. A cable in accordance with claim 2 wherein the elongate body is of a first braided construction having at least one conductive element providing electrical continuity between one end of the elongate body and another end of the elongate body and so provide one of said electrical conductors.

4. A cable in accordance with claim 3 wherein the first braided construction has two or more conductive elements, each providing electrical continuity between the one end of the elongate body and another end of the elongate body and so each provides one of said electrical conductors, each conductive element in the first braided construction being held in spaced relationship and therefore in electrical isolation from any conductive elements of the first braided construction by electrically insulating material of the braided construction.

5. A cable in accordance with claim 1 wherein at least one of the two or more electrical conductors is arranged on the surface of the electrically insulating material of the elongate body.

6. A cable in accordance with claim 5 wherein the at least one conductor arranged on the surface is provided in the form of a conductive element of a further braided construction concentric with and surrounding a first braided construction.

7. A cable in accordance with claim 1 wherein at least one of the two or more electrical conductors are fully enclosed by the electrically insulating material forming the elongate body.

8. A cable in accordance with claim 7 wherein the at least one conductor fully enclosed by the electrically insulating material forming the body is provided in the form of a conductive element of a further braided construction concentric with and enclosed by a first braided construction.

9. A cable in accordance with claim 3 where the at least one conductive element is comprised of single yarns or multiple yarns.

10. A cable in accordance with claim 1 wherein the two or more electrical conductors are substantially helical with respect to the longitudinal axis of the elongate body.

11. A cable in accordance with claim 1 wherein the electrical conductors are of a conductive metal, metal coated insulators or carbon fibre or conductive polymers.

12. A cable in accordance with claim 1 wherein the cable further comprises an insulator of nylon, polyamide, acetate, cotton or wool.

13. A method of producing an electrical cable comprising the step of:

producing at least one braiding wherein the at least one braiding includes two or more electrical conductors arranged to helically extend along the length of the cable wherein each of the at least two or more electrical conductors are arranged to remain in electrical isolation from one another by means of an interwoven electrically insulating material.

* * * * *